US006832415B2

(12) United States Patent
Higginbotham et al.

(10) Patent No.: US 6,832,415 B2
(45) Date of Patent: Dec. 21, 2004

(54) RELEASABLE SLIDE FASTENER CLOSURE

(75) Inventors: Paul Higginbotham, Richmond (CA); Pin Yin Sheu, Delta (CA)

(73) Assignee: Mustang Surgical Corp, Richmond (CA)

( * ) Notice: Subject to any disclaimer, the term of this patent is extended or adjusted under 35 U.S.C. 154(b) by 4 days.

(21) Appl. No.: 10/365,468

(22) Filed: Feb. 13, 2003

(65) Prior Publication Data

US 2004/0158956 A1 Aug. 19, 2004

(51) Int. Cl.[7] ..... A44B 19/00
(52) U.S. Cl. ..... 24/399; 24/381
(58) Field of Search ..... 24/399, 403, 433, 24/381, 382, 385–388, 390–396; 2/96, 100, 128

(56) References Cited

U.S. PATENT DOCUMENTS

| | | | | | |
|---|---|---|---|---|---|
| 1,775,232 | A | * | 9/1930 | Blair | 24/407 |
| 1,776,847 | A | * | 9/1930 | Blair | 24/391 |
| 1,934,084 | A | * | 11/1933 | Murphy | 24/386 |
| 2,063,879 | A | * | 12/1936 | Norton | 24/435 |
| 2,146,714 | A | * | 2/1939 | Austin | 24/433 |
| 2,191,280 | A | * | 2/1940 | Kiessling | 24/435 |
| 2,241,841 | A | * | 5/1941 | Beckwith | 2/96 |
| 2,281,000 | A | * | 4/1942 | Carlile | 24/388 |
| 2,296,680 | A | | 9/1942 | Smith | |
| 2,296,880 | A | * | 9/1942 | Smith | 24/391 |
| 2,463,937 | A | * | 3/1949 | Austin | 24/433 |
| 2,650,402 | A | * | 9/1953 | Kuzmick | 24/436 |
| 2,988,796 | A | * | 6/1961 | Moine | 24/436 |
| 2,997,766 | A | * | 8/1961 | McNamara | 24/432 |
| 3,947,931 | A | | 4/1976 | Takamatsu | |
| 4,000,545 | A | * | 1/1977 | Takamatsu | 24/404 |
| 4,109,349 | A | * | 8/1978 | Tanaka | 24/436 |
| 4,437,210 | A | * | 3/1984 | Fukuroi | 24/435 |
| 4,752,992 | A | * | 6/1988 | Kondo et al. | 24/436 |
| 5,400,482 | A | * | 3/1995 | Oda | 24/433 |
| 5,836,058 | A | * | 11/1998 | Cullum | 24/401 |

* cited by examiner

*Primary Examiner*—Robert J. Sandy
*Assistant Examiner*—Ruth C. Rodriguez
(74) *Attorney, Agent, or Firm*—C. A. Rowley

(57) ABSTRACT

A releasable slide fastener closure is formed by a pair of stringers with elements that interlock when in cooperating closed position and a slider mounted on the stringers for sliding movement along said stringers to move the elements into said interlocking closed position on movement in of the slider away from a first end and toward a second or closed end. Each of the stringers has a stop for preventing said slider from separating there from at each of its ends and the stringers are free to separate from closed position at the first end when a force is applied in a predefined direction adjacent to the first end.

3 Claims, 3 Drawing Sheets

RELEASABLE SLIDE FASTENER CLOSURE

FIELD OF THE INVENTION

The present invention relate of a slide fastener type closure, more particularly to a slide fastener type closure wherein the closure may be easily opened by a force applied preferably adjacent to an open end of the closure

BACKGROUND OF THE INVENTION

Interlocking fasteners of the type formed by a pair of continuous coils or intermeshing teeth or interlocking elements capable of being intermeshed against separation by a transverse pull and capable of being meshed together and unmeshed by the movement of a slider thereto are known (such as shown in the Smith U.S. Pat. No. 2,296,880 issued Sep. 29, 1942 and Takamatsu, U.S. Pat. No. 3,947,931 issued Apr. 6, 1976). Slide fasteners of this type are in general comprised a pair of wound helical coils of continuous filament or individual teeth attached to the edges of a tape to form a stringer, which in turn is attached to the edges of a cover, slit or opening which can be closed when the slider passes in one direction lengthwise and opened by sliding the slider lengthwise in the opposite direction. The slider distorts the tape and coils or teeth such that alternate loops or teeth formed by elements on the opposed stringers can lock or unlock together with coils or teeth on the opposite side of the cover, slit or opening depending upon the direction of sliding of the slider.

In a typical application of a slide fastener used to close a cover slit or opening, one end of the fastener has the two sides of the fastener (opposed stringers) prevented from separating by being clamped or otherwise permanently held together, this end being known as the closed end and the opposite end free to separate which called the open end, the slider is arranged such that when slid towards the closed end of the zipper the coils or teeth are unengaged and when slid towards the open end the coils or teeth are engaged together, with the coils or teeth thus engaged they are prevented from easily being disengaged from each other by the last few coils or teeth being held together within the body of the slider.

It has been the practice for a number of years in packaging of some military gear such as military inflatables hook and loop fasteners have been used and in some cases have been replaced by a slide fastener having no end stops has been used. The slide fastener system closure system opened automatically but was closed by threading a slider onto one end and removing it completely from the other. This operation was quite tricky and time consuming and was much too difficult to be done while wearing the device. After the inflatable had been used it had to be returned to a workshop for repacking i.e. it was similar to having a parachute repacked after each usage.

BRIEF DESCRIPTION OF THE PRESENT INVENTION

It is an object of the present invention to provide a releasable slide fastener closure system that may be easily reclosed without reassembly.

Broadly the present invention relates to a releasable slide fastener closure for closing an opening while permitting opening by application of a force in a predefined direction, said closure comprising a slide fastener formed by a first and second stringer each formed by a plurality of side by side interlocking elements mounted on a tape, said interlocking elements on said first stringer cooperating with said interlocking elements on said second stringer to hold said first and second stringers together and thereby said closure in a closed position when said cooperating interlocking elements are in an interlocking closed position, a slider mounted on said stringers for sliding movement along said stringers relative to said interlocking elements to move said elements into said interlocking closed position on movement of said slider in one direction from a first end of said closure toward a second end of said closure, each of said stringers has a stop means for preventing said slider from separating there from at said first end and at said second end, said stringers being free to separate from said interlocking closed position at said first end when said force is applied in said predefined direction adjacent to said first end.

Preferably said elements are coil elements.

Preferably said stringers are interconnected at said second end by a connection means.

Preferably said connection means provides said stop means at said second ends of said first and second stringers.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

As above indicated the present invention relates to a means of providing a secure closure of a cover, slit or opening by holding the edges of the cover, slit or opening together by means of a slide type fastener and more particularly to the use of the slide fastener such that the cover, slit or opening will resist being opened by transverse loads substantially along its entire length but can be easily opened by separation of the slide fastener if that separation is initiated by a much smaller transverse load applied to one end (open end) of the slide fastener.

Figure 1:
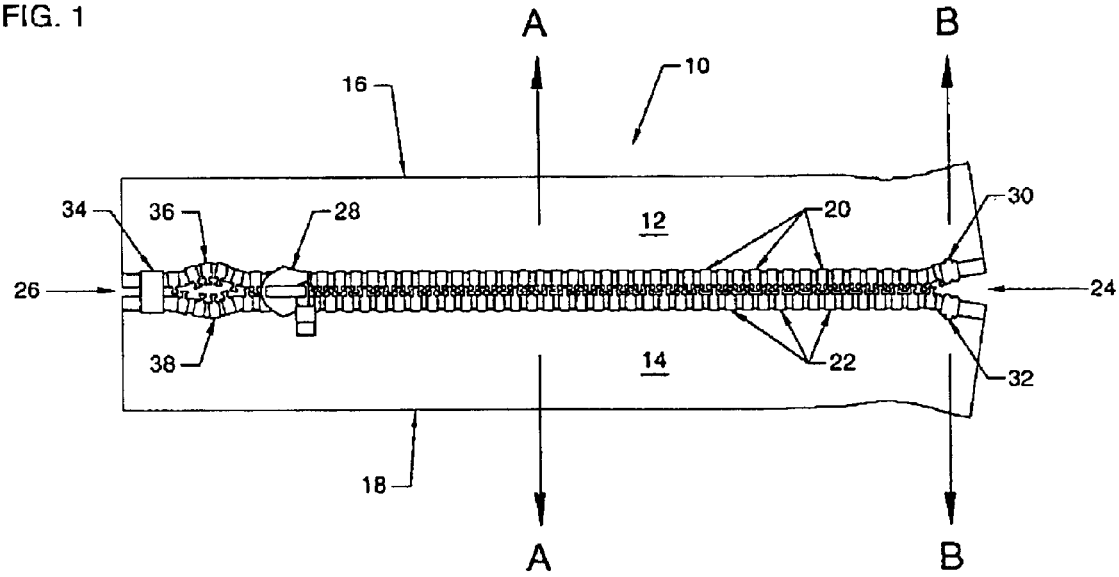
FIG. 1 is a plan view of a zipper or slide fastener closure incorporating the present invention and shown in a closed position.

Referring to FIG. 1 the slide fastener or zipper 10 of the present invention is composed of a pair of stringers 12 and 14 each of which is formed in the conventional manner by a tape 16 and 18 respectively each of which mounts a plurality of side by side interconnecting elements 20 and 22 respectively which elements inter-engage when the zipper is in closed position as indicated in FIG. 1 to hold the stringers in adjacent or side by side relationship.

The zipper or closure 10 has a first or open end 24 and an opposite end 26, which is normally closed and thus may be referred to as the closed end 26. A slider 28 is mounted to slide along the stringers 12 and 14 and cause the elements 20 and 22 to engage each other and place the zipper 10 in closed position as shown in FIG. 1 when the slider 28 is moved from adjacent to the first or open end 24 to the second or closed end 26 i.e. in the direction D shown in FIG. 4 (and 6).

Each of the stingers 12 and 14 is provided with a stop 30 and 32 respectively located at the end of the row of elements 20 and 22 respectively adjacent to the first or free end 24 of the zipper 10. The stops 30 and 32 may be provided in the form of a clenched metal or plastic tab or other projection secured to the stringers 12 or 14 and that is too large to pass through the body of the slider 28.

These stops 30 and 32 play a very important roll in the present invention in that they prevent the slider 28 from coming off the stringer 12 or 14 at the open end 24 of the zipper.

At the closed end 26 of the zipper 10 a further stop is provided as indicated at 34, that in the illustrated arrangement not only prevents the slide 28 from coming off the either of the stringer 12 and 14 but also couples the two stringers 12 and 14 together so they cannot be separated. Thus as the slider 28 approaches the stop the stringers tend to bow outward as indicated at 36 and 38 for the stringers 12 and 14 respectively.

Figure 5:
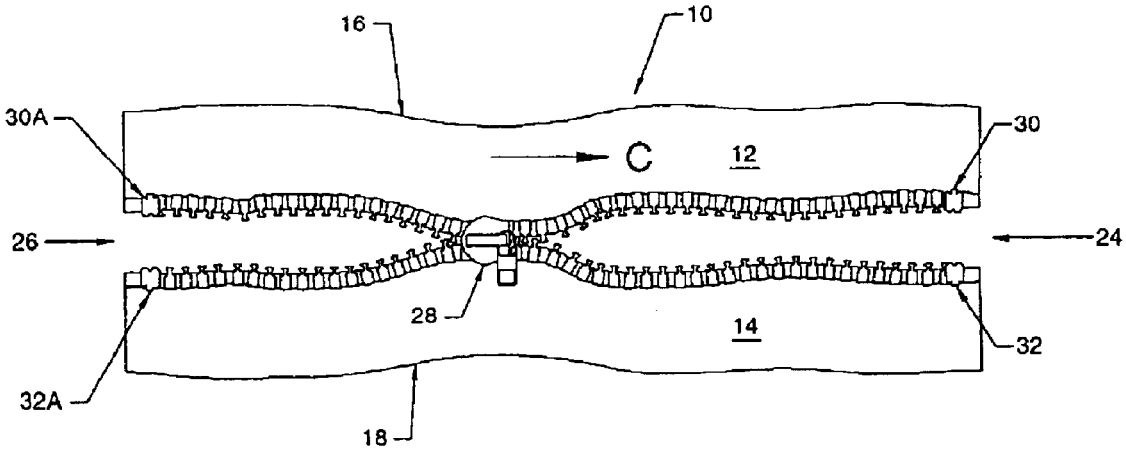
FIG. 5 is a view similar to FIG. 3 but showing a zipper when discreet stops at each end of each stringer have be used.
Figure 6:
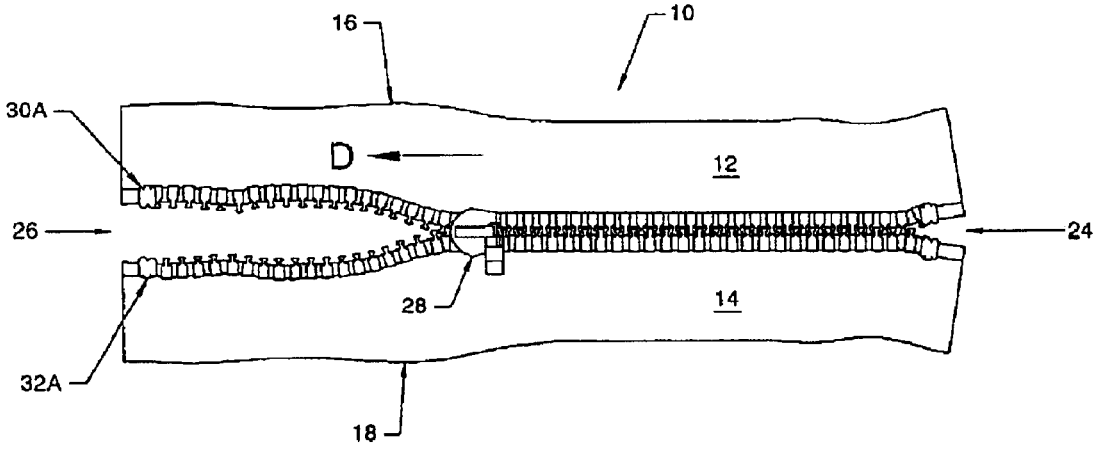
FIG. 6 is a view similar to FIG. 4 but showing a zipper when discreet stops at each end of each stringer have be used.

In the embodiment shown in FIGS. 5 and 6 the stop 34 has been replace by a pair of stops 30A and 32A so that the closed end 26 is in effect a mirror of the open end 24. In this embodiment the slider 28 itself functions to prevent separation of the two stringers and acts in the manner of the stop 34 when the slider is at the closed end 26 as would be the case when the zipper is closed.

Figure 2:
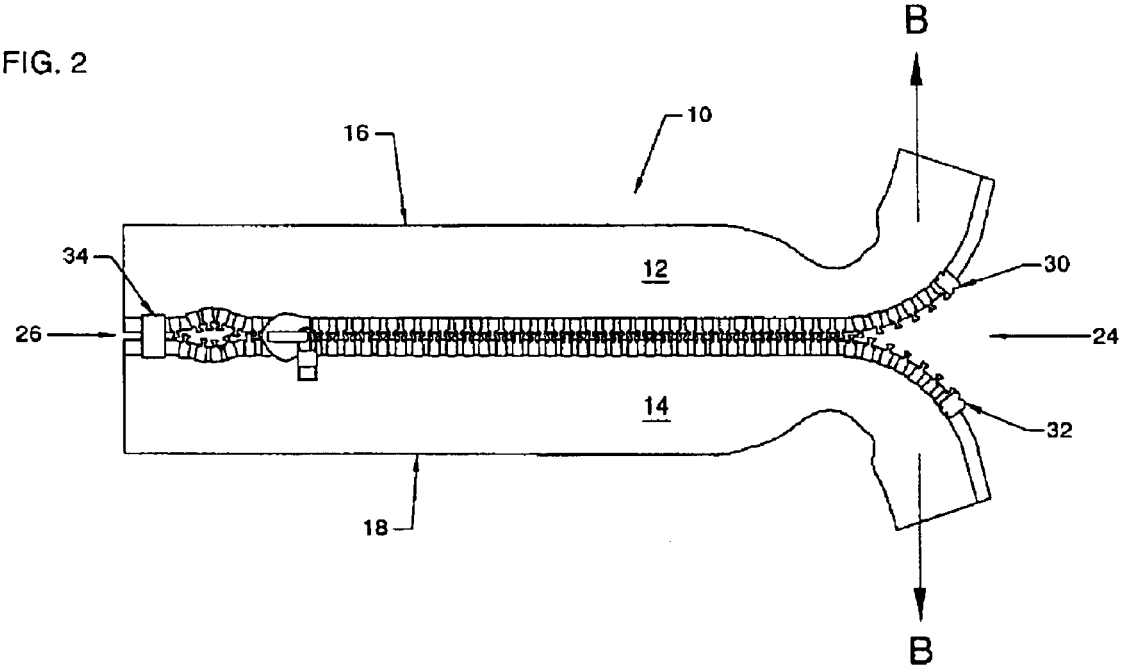
FIG. 2 is a view similar to FIG. 1 but shown the effect of the initial application of an opening force applied at a first or open end of the closure.
Figure 3:
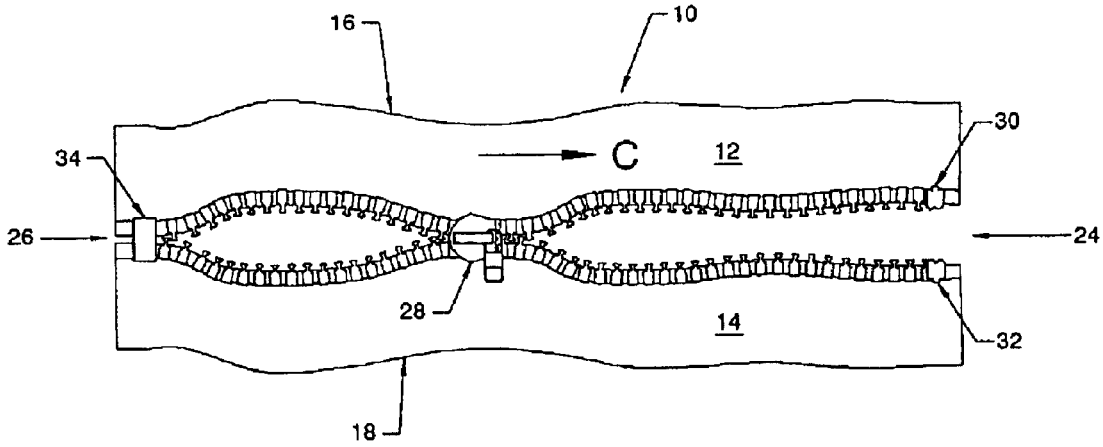
FIG. 3 shows the closure after opening and the slider partway toward the open end of the closure to move the slider into a position to reclose the zipper.
Figure 4:
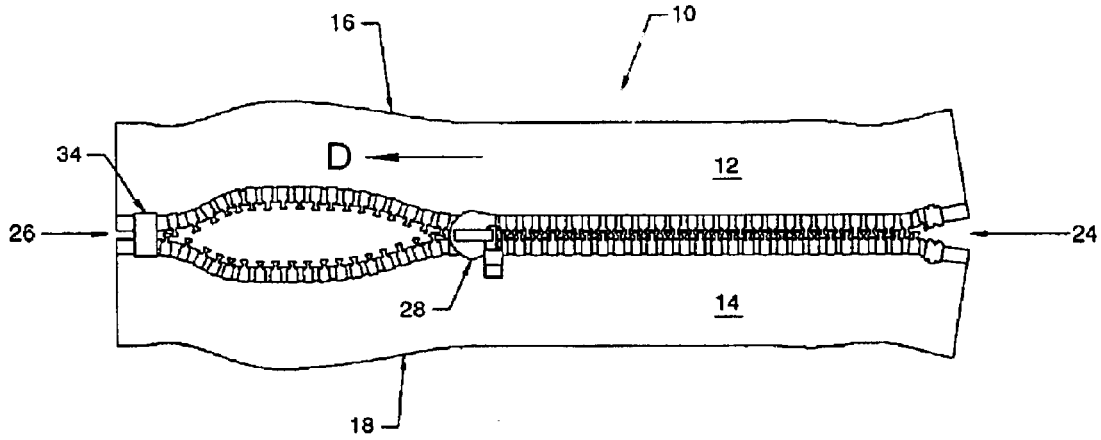
FIG. 4 shows the slider being moved to close the zipper.

It will be apparent that in the present invention, the slider 28 is arranged facing the opposite direction as in a conventional zipper closure wherein as shown in FIG. 3 or 5 when the slider 28 is slid in direction C towards the open end the coils or teeth (interengaging elements) 20 and 22 are disengaged and when slid in direction D towards the closed end 26 shown in FIGS. 4 and 6, the coils or teeth (interengaging elements) 20 and 22 are engaged. The result of this arrangement is that when the slider 28 is slid in direction D to the closed end of the cover, slit or opening, which the zipper closes, separation by disengagement of the coils or teeth (interengaging elements) 20 and 22 of the two sides can easily be initiated by a small transverse force B (see FIGS 1 and 2) applied at the open end 24 whereas a much larger transverse force A (FIG. 1) applied anywhere along the remaining length of the slide fastener or zipper 10 will be resisted without the coils or teeth (interengaging elements) 20 and 22 becoming disengaged. This permits the cover, slit or opening to be opened relatively easily for example by inflation of an inflatable element positioned within the pouch or pocket closed by the zipper 10.

It has been found that most zippers (interengaging elements) are functional for the purpose of the present invention. However depending on the application to which the present invention is to be applied some zippers may be more effective than others. The difference in effectiveness of the zipper structures is basically dependent on how smoothly the slider runs during the resetting process i.e. the whole of the action of closing the zipper after it has been "torn" opened and involves two motions, one to move the slider to the open end, then back to the closed end so that the closure is closed and ready to be torn open again.

For example if the invention is to be applied to a multi cycle application such as closing a pocket smoothness of operation and longevity are important whereas for uses as inflatable cover the zipper will probably be used only a few times and these factor are not as important.

It is important that the zipper be selected that has the required resistance to opening when and opening force is applied as indicated at B so that the force B applied adjacent to the stops 30 and 32 must be of a selected minimum before the zipper will open and the zipper must strongly (strength being dependent on application) resist opening when forces are applied as indicated at A, spaced a distance or more than 2.5 centimeters (cm) from the open end or stops 30 and 32 of the zipper 10 measured along the stringers 12 and 14 so that the force required to be applied at a distance of 2.5 cm is at least 1.5 times the force B applied at the open end to cause the zipper to open.

A coil or toothed zipper 10 used in the present invention will normally have a cross ways strength (force in a direction substantially perpendicular to the the axial length (opening and closing directions) of the zipper) of from 10 lbs force to 200+ lbs force per inch of its length depending on the size where as the force needed to initiate and propagate separation is never more than 1 lb force applied adjacent to the open end 24.

Applied forces perpendicular to the forces A and B have essentially the same effect as forces in the same direction as A and B because the tapes of the zipper 10 simply twist to substantially align with the applied forces.

The major advantage of the present invention that overcomes a problem that has faced the industry for a number of years is that once the zipper has been opened by applying forces as indicated at B to disengage the coils or teeth (interengaging elements) 20 and 22 the interengaging elements 20 and 22 can readily be recoupled to close the zipper 10 by sliding the slider 28 in direction C (FIG. 3) to the open end 24 and then returning it in direction D (FIG. 4 or 6) to the closed end 26 to reengage the interengaging elements 20 and 22.

The stops 30, 32 and 34 which provide the means of preventing the slider 28 becoming disengaged from the coils or teeth (interengaging elements) 20 and 22 at the open and closed ends overcomes the rethreading problem that has persisted over the years.

It will be apparent that in producing the zippers of the present invention at least some of the stops must be applied to the stringers after the slider has been assembled in position. For example the stops 30 and 32 at the open end 24 of the zipper 10 will normally be applied after the slider ibis in position on the stringers 12 and 14.

As indicated a prime application for this invention is to close the cover over a folded inflatable cell. The ideal closing method for this application would have great resistance to accidental opening but would offer little resistance when it is required to open for the purposes of allowing the inflatable cell to expand. The covers of inflatable life preservers are typically closed by means of hook and loop fasteners but while this type of fastener allows the inflatable cell to expand when it is inflated, it offers insufficient resistance to accidental opening. An example of a particular need for a cover with the properties described is the cover for the inflatable cell used as a life preserver and worn by pilots of high-speed aircraft equipped with ejection seats. During ejection from the aircraft, the cover of the life preserver is subjected to very high wind loads and must remain closed to prevent the inflatable cell from being damaged, however, when inflation is actuated just prior to landing in water the cover must open easily to allow the cell to inflate.

Another application where a cover with the properties described might be desirable is for the closure of a pocket wherein the pocket must remain securely closed and resist accidental opening in order to protect the contents, for example where the contents might be a firearm or emergency equipment but where rapid and easy access to the contents is desirable.

If the open end of the slide fastener applied to the cover, slit or opening is located at an out of the way position for example at the back of the neck, or is protected from accidental transverse loads by means of snap fastener or similar means, the cover will not accidentally be opened.

Having described the invention, modifications will be evident to those skilled in the art without departing from the scope of the invention as defined in the appended claims.

We claim:

1. A releasable slide fastener closure for closings an opening while permitting opening by application of a force in a predefined direction, said closure comprising a slide fastener formed by a first and second stringer each formed by a plurality of side by side interlocking elements mounted on a tape, said interlocking elements on said first stringer cooperating with said interlocking elements on said second stringer to hold said first and second stringers together and thereby said closure in a closed position when said cooperating interlocking elements are in an interlocking closed position, a slider mounted on said stringers for sliding movement along said stringers relative to said interlocking elements to move said elements into said interlocking closed position on movement of said slider in one direction from a first end of said closure toward a second end of said closure, said slider providing the sole means for moving said elements into interlocking closed position, each of said stringers has a stop means for preventing said slider from separating there from at said first end and at said second end, said stringers being free to separate from said interlocking closed position at said first end when said force is applied to at least one of said first and second stringers in said predefined direction adjacent to said first end.

2. A releasable slide fastener closure as defined in claim 1 wherein said stringers are interconnected at said second end by a connection means.

3. A releasable slide fastener closure as defined in claim 2 wherein said connection means provides said stop means at said second ends of said first and second stringers.

* * * * *

UNITED STATES PATENT AND TRADEMARK OFFICE

CERTIFICATE OF CORRECTION

PATENT NO. : 6,832,415 B2
DATED : December 21, 2004
INVENTOR(S) : Higginbotham et al.

It is certified that error appears in the above-identified patent and that said Letters Patent is hereby corrected as shown below:

Title page,
Item [73], Assignee, "Surgical" should read -- Survival --

Signed and Sealed this

Twelfth Day of April, 2005

JON W. DUDAS
*Director of the United States Patent and Trademark Office*